US011577371B2

(12) United States Patent
Su

(10) Patent No.: US 11,577,371 B2
(45) Date of Patent: Feb. 14, 2023

(54) WRENCH CAPABLE OF APPLYING DRIVING FORCE ON OBJECT EFFECTIVELY

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 220 days.

(21) Appl. No.: 17/070,467

(22) Filed: Oct. 14, 2020

(65) Prior Publication Data

US 2021/0220976 A1 Jul. 22, 2021

(30) Foreign Application Priority Data

Jan. 17, 2020 (TW) ..... 109101745

(51) Int. Cl.

| | |
|---|---|
| ***B25B 23/00*** | (2006.01) |
| ***B25B 13/28*** | (2006.01) |
| ***B25G 1/06*** | (2006.01) |
| ***B25B 13/12*** | (2006.01) |

(52) U.S. Cl.

CPC ..... *B25B 23/0028* (2013.01); *B25B 13/12* (2013.01); *B25B 13/28* (2013.01); *B25G 1/063* (2013.01)

(58) Field of Classification Search

CPC ..... B25B 23/0028; B25B 13/12; B25B 13/28; B25G 1/063

USPC ..... 81/177.8, 177.9

See application file for complete search history.

(56) References Cited

U.S. PATENT DOCUMENTS

| | | | | |
|---|---|---|---|---|
| 3,309,949 | A * | 3/1967 | Neff | B25B 13/46 81/111 |
| 5,768,960 | A | 6/1998 | Archuleta | |
| 6,167,787 | B1 | 1/2001 | Jarvis | |
| 6,324,947 | B2 | 12/2001 | Jarvis | |
| 7,000,507 | B1 | 2/2006 | Lin | |

(Continued)

FOREIGN PATENT DOCUMENTS

| | | |
|---|---|---|
| TW | 215602 | 11/1993 |
| TW | 218997 | 1/1994 |

(Continued)

*Primary Examiner* — Joseph J Hail

*Assistant Examiner* — Caleb Andrew Holizna

(74) *Attorney, Agent, or Firm* — Alan D. Kamrath; Karin L. Williams; Mayer & Williams PC

(57) ABSTRACT

A wrench has a first segment and a second segment pivotally coupled together. The second segment is selectively positionable at various fixed pivotal positions relative to the first segment. The first and the second segments engage with a locking device. The first segment has a first joining end forming a first positioning surface and a second positioning surface. The locking device includes a catch selectively engagable and disengagable from the first and the second positioning surfaces. The catch has a body section abutting against the first positioning surface in a direction radial to the axis of rotation when the first segment is at a first fixed pivotal position relative to the second segment. The first body section is abutted against the second positioning surface in a direction radial to the axis of rotation when the first segment is at a second fixed pivotal position relative to the second segment.

14 Claims, 9 Drawing Sheets

(56) References Cited

U.S. PATENT DOCUMENTS

| | | | | |
|---|---|---|---|---|
| 7,171,875 | B2 | 2/2007 | Hu | |
| 2004/0144218 | A1* | 7/2004 | Hu | B25G 1/063 81/177.8 |
| 2014/0224077 | A1 | 8/2014 | Doumenis, Jr. | |

FOREIGN PATENT DOCUMENTS

| | | | |
|---|---|---|---|
| TW | M305734 | U | 2/2007 |
| TW | M376389 | U | 3/2010 |
| TW | M385439 | U | 8/2010 |
| TW | I364346 | B | 5/2012 |
| TW | I389772 | B | 3/2013 |
| TW | I608906 | B | 12/2017 |
| TW | M587579 | U | 12/2019 |

* cited by examiner

WRENCH CAPABLE OF APPLYING DRIVING FORCE ON OBJECT EFFECTIVELY

BACKGROUND OF THE INVENTION

1. Field of the Invention

The present invention relates to a wrench and, particularly, to a wrench capable of applying driving force on an object to be driven effectively.

2. Description of the Related Art

TW Pat. No. M M587579 discloses a flex-head ratcheting wrench, which includes a handle and a head pivotally coupled to the handle. The head is adapted to be fixed at various angles with respect to the handle. Particularly, the flex-head ratcheting wrench includes a positioning mechanism selectively restraining and freeing pivotal movement of the head with respect to the handle. The positioning mechanism includes a pawl and a control actuating the pawl. The control is movable to a first position in which the head is engaged with the pawl and restrained and a second position in which the head is disengaged from the pawl and freed.

If teeth of the pawl and the head are damaged or deformed, the positioning mechanism is unable to restrain the head. Therefore, a user can not apply driving force effectively when the positioning mechanism can restrain the head.

The present invention is, therefore, intended to obviate or at least alleviate the problems encountered in the prior art.

SUMMARY OF THE INVENTION

According to the present invention, a wrench capable of applying driving force on an object to be driven effectively has a first segment and a second segment pivotally coupled to the first segment. The first segment includes a driving end of the wrench. The second segment is pivotally coupled to the first segment about an axis of rotation and selectively positionable at various fixed pivotal positions relative to the first segment. The first and the second segments engage with a locking device which is configured for selectively preventing and allowing rotation of the first segment with respect to the second segment. The first segment has a first joining end forming a first positioning surface and a second positioning surface. The first and the second positioning surfaces are curved. The second segment has at least one second joining end linked to the first joining end and the axis of rotation extends transversely to the first and the second joining ends. The locking device includes a catch selectively engagable and disengagable from the first and the second positioning surfaces. The first segment is rotatable with respect to the second segment when the catch is disengaged from the first and the second positioning surfaces. The first and the second segments are prevented from rotating relative to one another when the catch is engaged with either the first or the second positioning surface. The catch has a first body section abutting against the first positioning surface in a direction radial to the axis of rotation when the first segment is at a first fixed pivotal position relative to the second segment. The first body section is abutted against the second positioning surface in a direction radial to the axis of rotation when the first segment is at a second fixed pivotal position relative to the second segment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
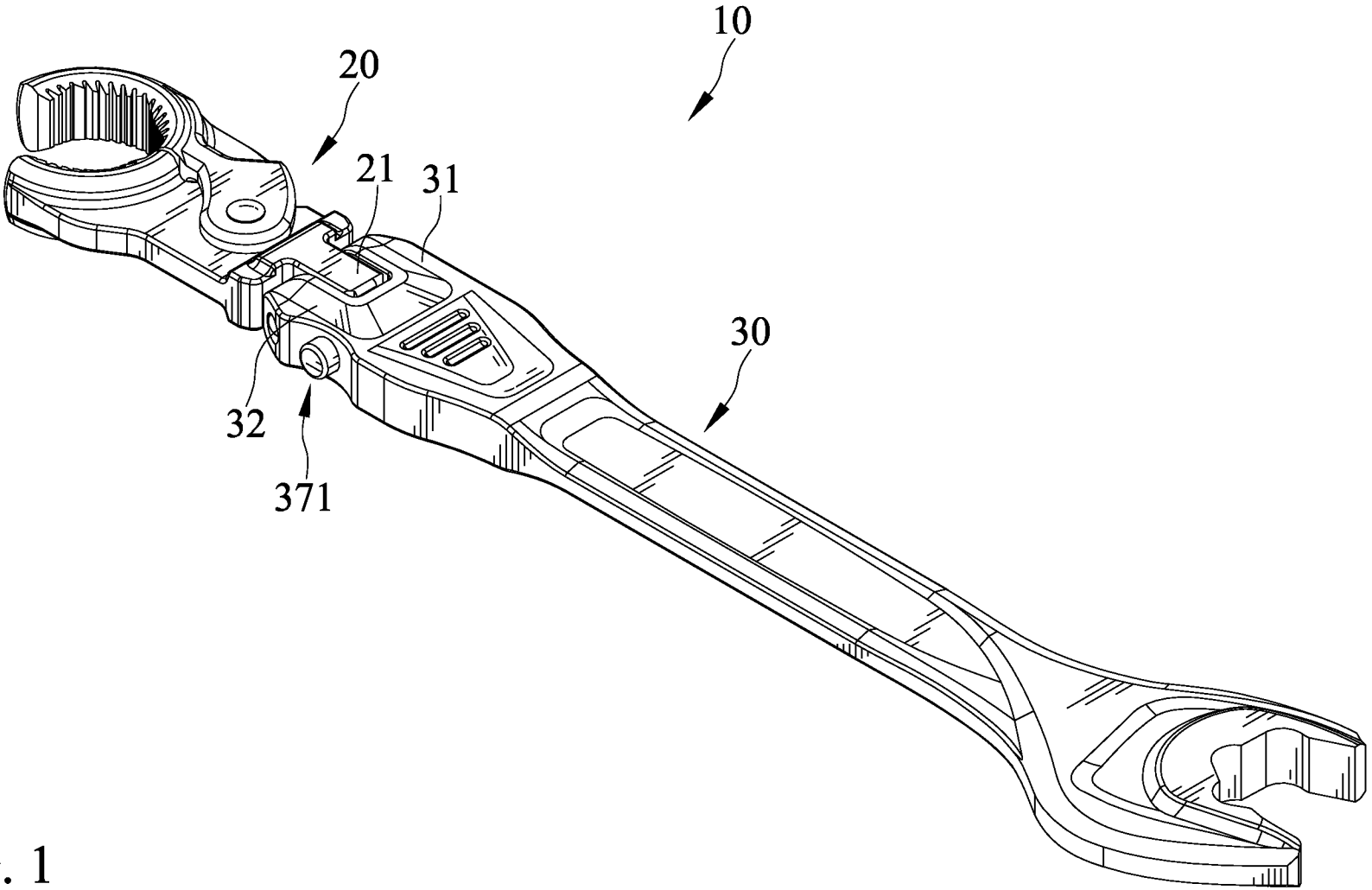
FIG. 1 is a perspective view of a wrench in accordance with a first embodiment of the present invention capable of applying driving force on an object effectively.
Figure 2:
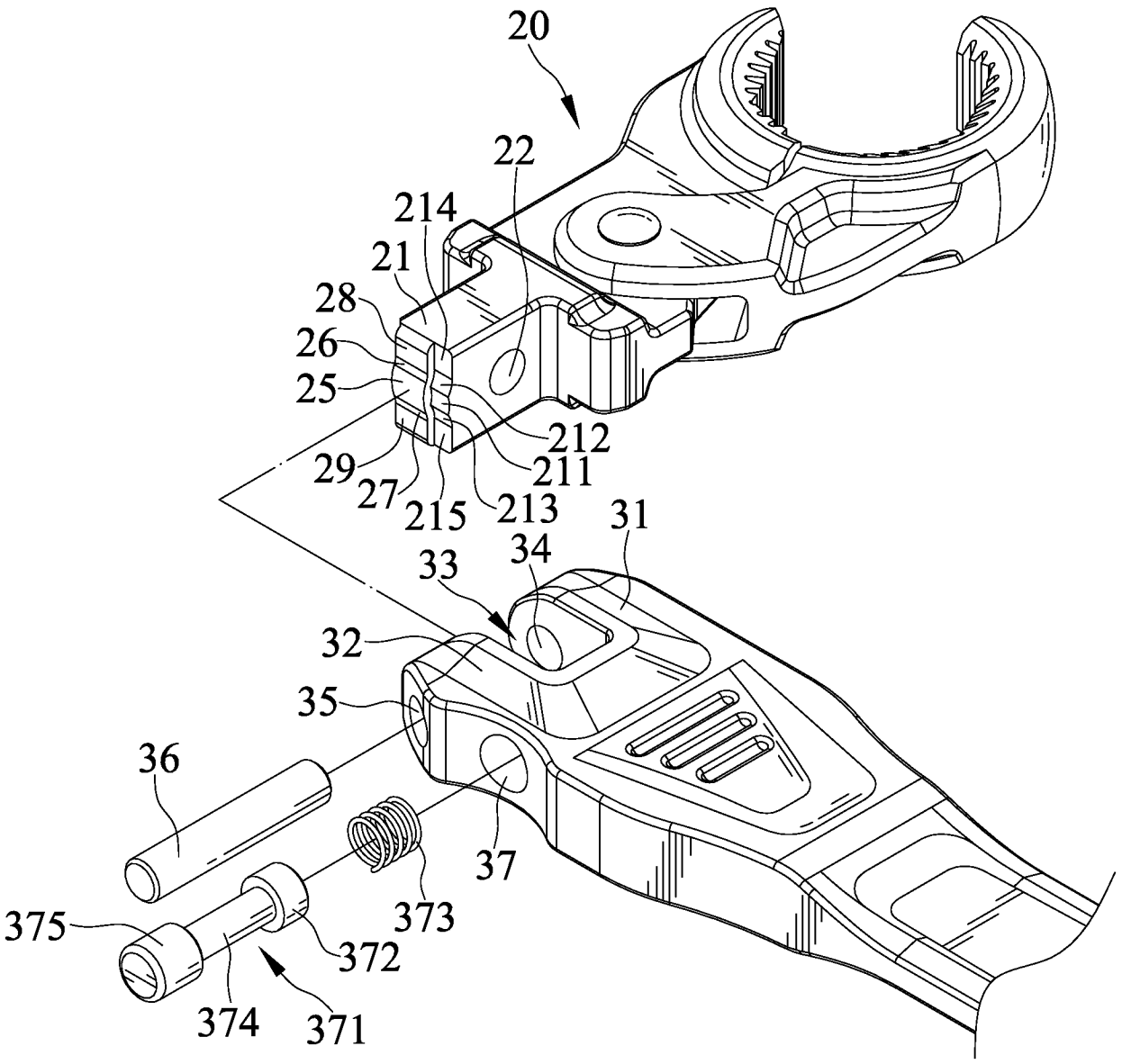
FIG. 2 is an exploded perspective view of a first structural member of the wrench.
Figure 3:
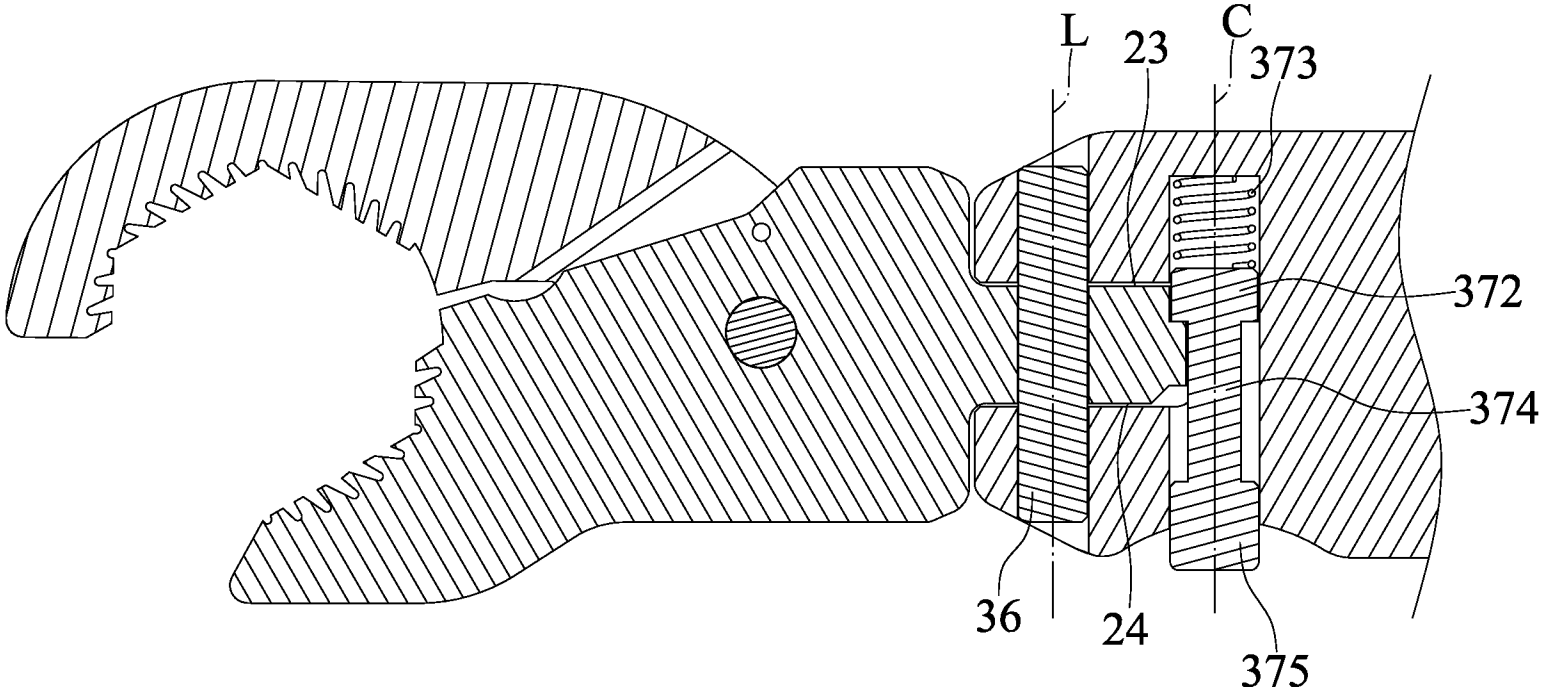
FIG. 3 is a cross-sectional view illustrating the first structural member of the wrench in the locked position.
Figure 4:
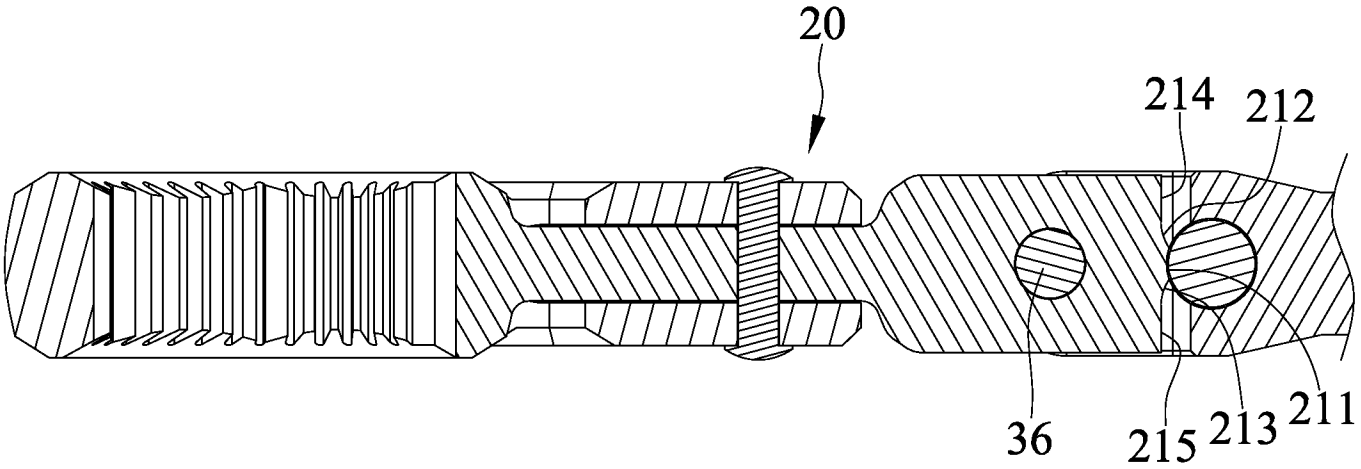
FIG. 4 is another cross-sectional view illustrating the first structural member of the wrench in the locked position.
Figure 5:
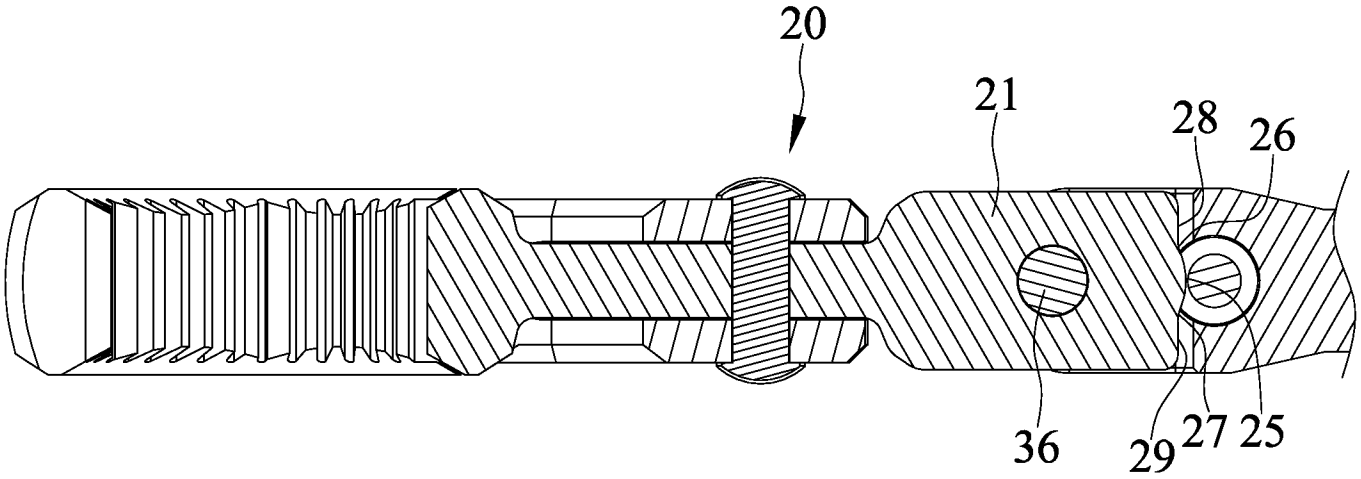
FIG. 5 is a further cross-sectional view illustrating the first structural member of the wrench in the locked position.
Figure 6:
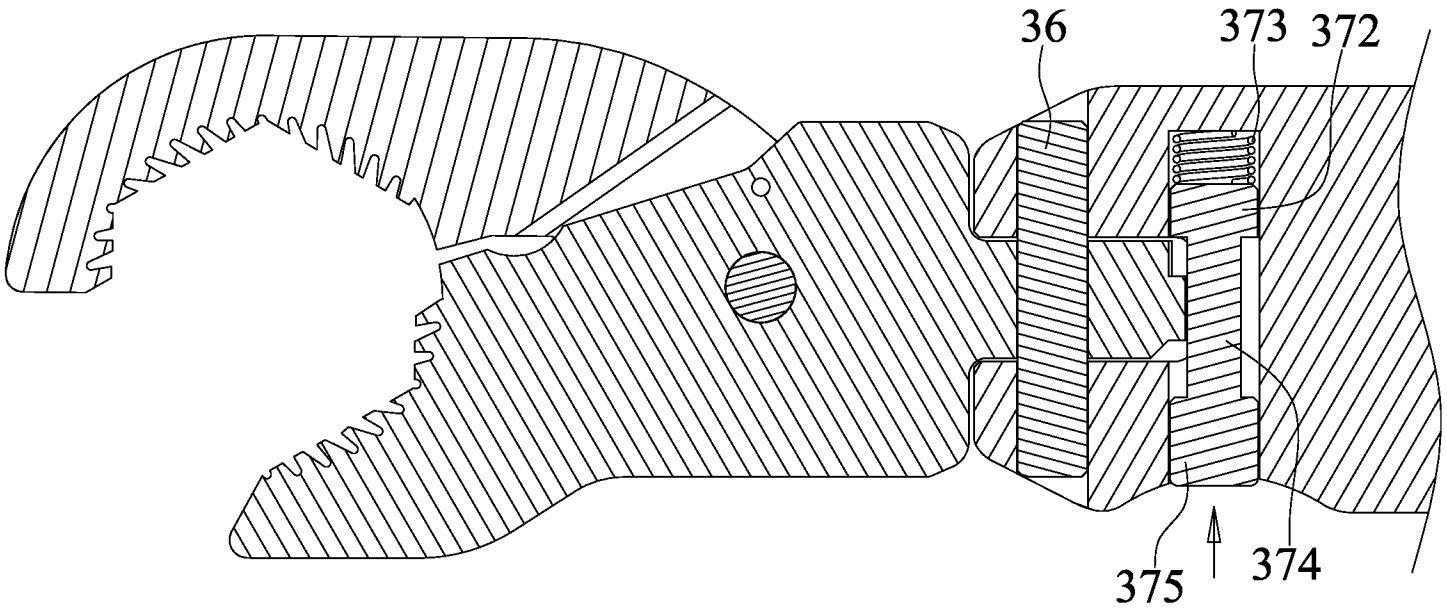
FIG. 6 is a cross-sectional view illustrating the first structural member of the wrench in the unlocked position.
Figure 7:
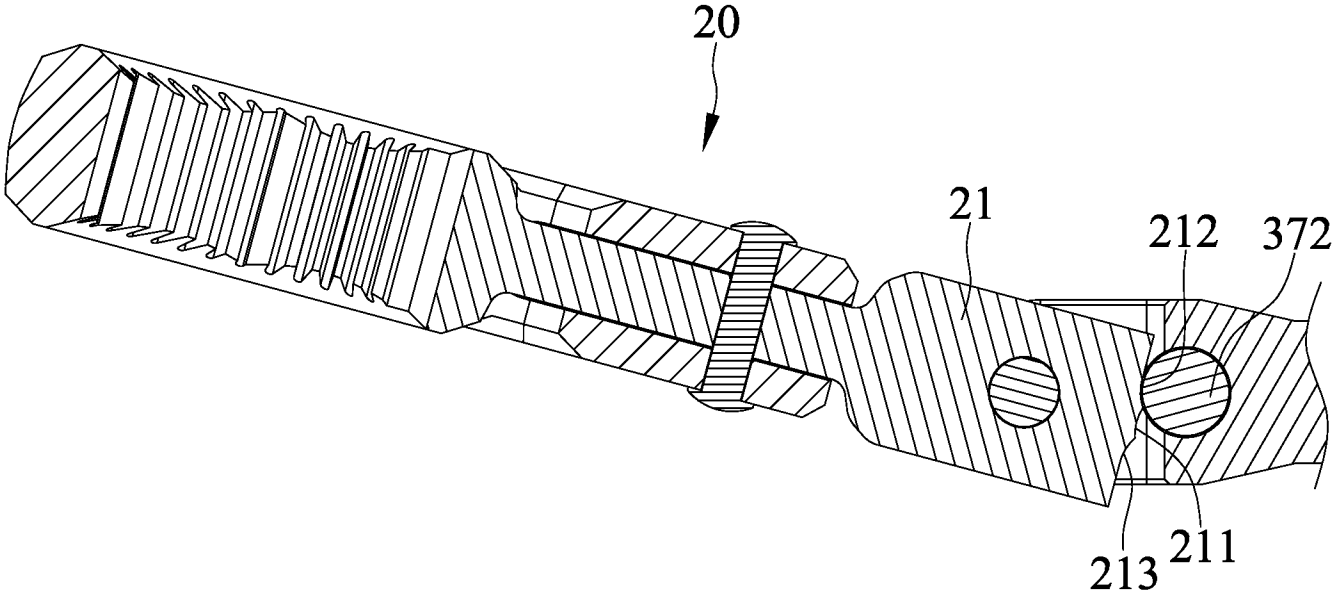
FIG. 7 is a cross-sectional view illustrating the first structural member of the wrench in a first pivoted position.
Figure 8:
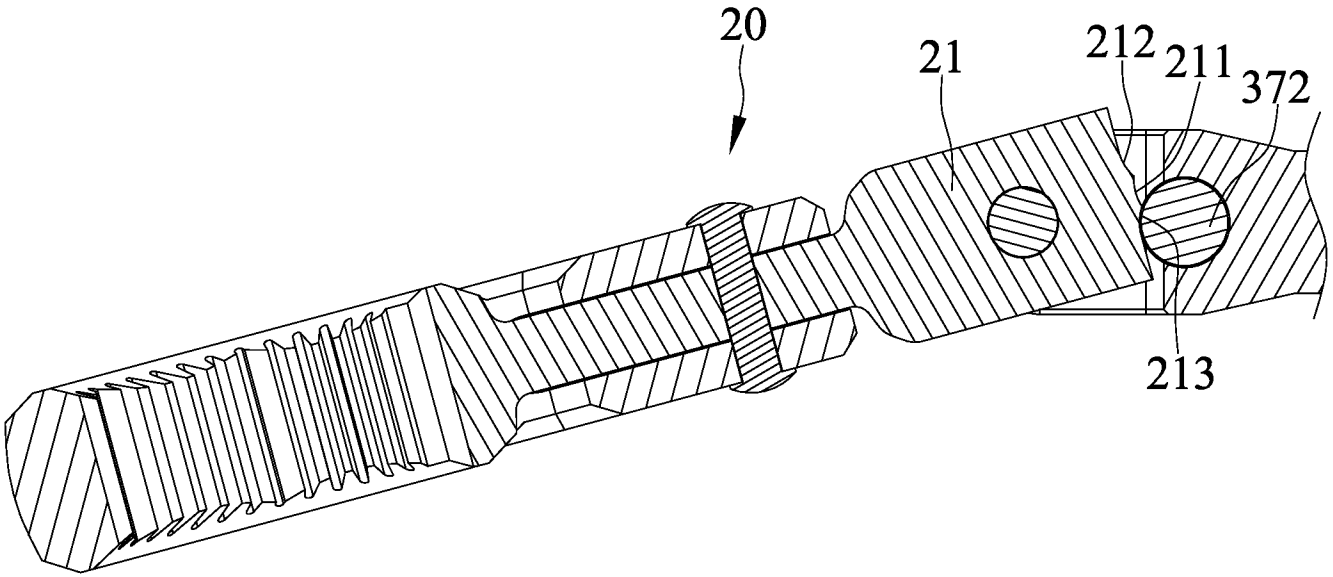
FIG. 8 is a cross-sectional view illustrating the first structural member of the wrench in a second pivotal position.

FIGS. 1 through 8 show a wrench 10 in accordance with the present invention capable of applying driving force on an object effectively. The wrench 10 includes a segment 20 and a segment 30 pivotally coupled to the segment 20 about an axis of rotation L. The segment 20 includes a driving end of the wrench 10. The driving end includes two jaws for driving the object and a space between the jaws for receiving the object. The segment 30 includes a handle end of the wrench 10.

The segment 20 has a joining end 21. The segment 30 has at least one joining end. The segment 30 includes the at least one joining end linked to the joining end 21. The at least one joining end has a joining end 31 and a joining end 32. The segment 30 defines a receiving space 33 between the joining ends 31 and 32. The joining end 21 is inserted into the receiving space 33. The joining end 21 defines an aperture 22. The joining ends 31 and 32 respectively define apertures 34 and 35 corresponding to the aperture 22. The segments 20 and 30 are pivotally coupled to each other by a pivot 36 which rotates about the axis of rotation L. The axis of rotation L extends transversely to the joining ends 21, 31, and 32. The pivot 36 is engaged in the apertures 22, 34 and 35. The aperture 22 extends through the joining end 21, the aperture 34 extends through the joining end 31, and the aperture 35 extends through the joining end 32, respectively. Further, the apertures 22, 34, and 35 extend along the axis of rotation L of the segments 20 and 30.

The segment 30 is selectively positionable at various fixed pivotal positions relative to the segment 20. The segments 20 and 30 engage with a locking device which is configured for selectively preventing and allowing rotation of the segment 20 with respect to the segment 30. The joining end 21 forms positioning surfaces 211, 212 and 213 and the locking device selectively interacting with the positioning surfaces 211, 212 and 213. The positioning surfaces 211, 212 and 213 are curved. The positioning surface 211 is disposed between the positioning surfaces 212 and 213. The positioning surfaces 211, 212 and 213 are concave. The locking device includes a catch 371 selectively engagable and disengagable from the positioning surfaces 211, 212 and 213. The segment 20 is rotatable with respect to the segment 30 when the catch 371 is disengaged from the positioning surfaces 211, 212 and 213. The segments 20 and 30 are prevented from rotating relative to one another when the catch 371 is engaged with either the positioning surface 211 or the positioning surface 212 or the third positioning surface 213.

The catch 371 has a body section 372 abutting against the positioning surface 211 in a direction radial to the axis of rotation L when the segment 20 is at a first fixed pivotal position relative to the segment 30. The body section 372 is abutted against the positioning surface 212 in a direction radial to the axis of rotation L when the segment 20 is at a second fixed pivotal position relative to the segment 30. The body section 372 is abutted against the positioning surface 213 in a direction radial to the axis of rotation L when the segment 20 is at a third fixed pivotal position relative to the segment 30. The catch 371 is axially displaceable along an axis C between positions in which the body section 372 is abutted against either the positioning surface 211 or the positioning surface 212 or the positioning surface 213 and a position in which the body section 372 is not abutted against the positioning surfaces 211, 212 and 213. The axis C is parallel to the axis of rotation L.

The catch 371 is movably disposed in a hole 37. The catch 371 is operable from a body section 375 thereof. The body sections 372 and 375 are at opposite ends of the catch 371. The body section 374 is disposed between the body sections 372 and 375. The catch 371 is urged by a resilient member 373.

The segments 20 and 30 include an included angle therebetween. The included angle defines a first included angle when the segment 20 is at the first fixed pivotal position relative to the segment 30 and a second included angle when the segment 20 is at the second fixed pivotal position relative to the segment 30. The included angle defines a third included angle when the segment 20 is at the third fixed pivotal position relative to the segment 30. The first and the second included angles have a difference in a range of 5-20 degrees. The first and the third included angles have a difference in a range of 5-20 degrees.

The joining end 21 has a side 23 and a side 24 disposed oppositely and the axis of rotation L extends transversely to the sides 23 and 24. The positioning surfaces 211, 212 and 213 are adjacent to the side 23. Moreover, the joining end 21 forms holding surface 25, 26 and 27 adapted to hold the catch 371. The holding surfaces 25, 26 and 27 are adjacent to the side 24. The holding surface 25 is disposed next to the positioning surface 211 and the holding surface 26 is disposed next to the positioning surface 212 and the holding surface 27 is disposed next to the positioning surface 213 respectively. The holding surface 25 and the positioning surface 211 are at different heights. The holding surface 26 and the positioning surface 212 are at different heights. The holding surface 27 and the positioning surface 213 are at different heights. The holding surface 25 is convex. The holding surfaces 26 and 27 are concave.

The catch 371 is selectively retained by the holding surfaces 25, 26 and 27. The catch 371 is also selectively engagable and disengagable from the holding surfaces 25, 26 and 27. The catch 371 has a body section 374 abutting against the holding surface 25 in a direction radial to the axis of rotation L when the segment 20 is at the first fixed pivotal position relative to the segment 30. The body section 374 is abutted against the holding surface 26 in a direction radial to the axis of rotation L when the segment 20 is at the second fixed pivotal position relative to the segment 30. The body section 374 is abutted against the holding surface 27 in a direction radial to the axis of rotation L when the segment 20 is at the third fixed pivotal position relative to the segment 30. The body section 374 has a smaller cross sectional than the body section 372. The holding surface 25 is at a further distance from the axis of rotation L than the positioning surface 211. The holding surface 26 is at a further distance from the axis of rotation L than the positioning surface 212. The holding surface 27 is at a further distance from the axis of rotation L than the positioning surface 213.

Further, the first joining end 21 forms a stopping surface 214 adjacent to the positioning surface 212, a stopping surface 215 adjacent to the positioning surface 213, a stopping surface 28 adjacent to the holding surface 26, and a stopping surface 29 adjacent to the holding surface 27. The stopping surfaces 214 and 215 are adjacent to the side 23. The positioning surface 212 is disposed between the positioning surface 211 and the stopping surface 214 and the positioning surface 213 is disposed between the positioning surface 211 and the stopping surface 215 respectively. The stopping surfaces 214 and 215 are flat. The holding surface 26 is disposed between holding surface 25 and the stopping surface 28 and the holding surface 27 is disposed between holding surface 25 and the stopping surface 29 respectively. The stopping surfaces 28 and 29 are flat.

Figure 9:
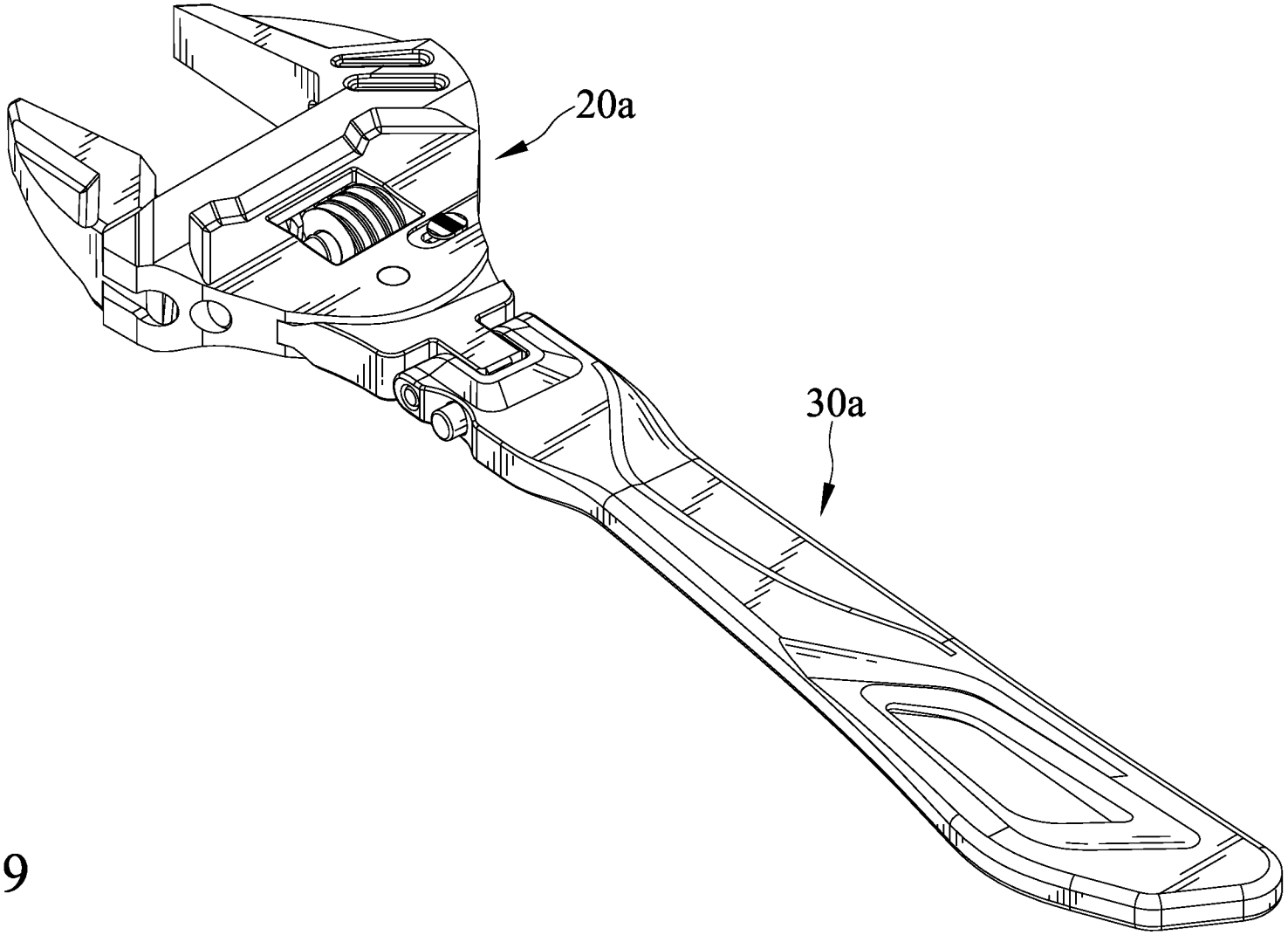
FIG. 9 is a perspective view of a wrench in accordance with a second embodiment of the present invention capable of applying driving force on an object effectively.

FIG. 9 shows a wrench in accordance with a second embodiment of the present invention, and the same numbers are used to correlate similar components of the first embodiment, but bearing a letter a. Similarly, the second embodiment has a segment 20*a* and a segment 30*a* being selectively positionable at various fixed pivotal positions relative to the segment 20*a*. The difference between the first and the second embodiments is that the segment 20*a* includes a driving end which includes one of two jaws selectively positionable at various fixed positions relative to the other jaw.

In view of the foregoing, the cooperation of the segments 20 and 30 and the locking device allows driving force to be applied on the object effectively.

The foregoing is merely illustrative of the principles of this invention and various modifications can be made by those skilled in the art without departing from the scope and spirit of the invention.

What is claimed is:

1. A wrench capable of applying driving force on an object to be driven effectively comprising:

a first segment including a driving end of the wrench, a second segment pivotally coupled to the first segment about an axis of rotation and being selectively positionable at various fixed pivotal positions relative to the first segment, wherein the first and the second segments engage with a locking device which is configured for selectively preventing and allowing rotation of the first segment with respect to the second segment, wherein the first segment has a first joining end forming a first positioning surface and a second positioning surface, wherein the first and the second positioning surfaces are curved, wherein the second segment has at least one second joining end linked to the first joining end and the axis of rotation extends transversely to the first and the second joining ends, wherein the locking device includes a catch selectively engagable and disengagable from the first and the second positioning surfaces, wherein the first segment is rotatable with respect to the second segment when the catch is disengaged from the first and the second positioning surfaces, wherein the first and the second segments are prevented from rotating relative to one another when the catch is engaged with either the first or the second positioning surface, wherein the catch has a first body section abutting against the first positioning surface in a direction radial to the axis of rotation when the first segment is at a first fixed pivotal position relative to the second segment, and wherein the first body section is abutted against the second positioning surface in a direction radial to the axis of rotation when the first segment is at a second fixed pivotal position relative to the second segment; and wherein the first joining end forms a first holding surface and a second holding surface, wherein the catch is selectively retained by the first and the second holding surfaces, wherein the catch is selectively engagable and disengagable from the first and the second holding surfaces, wherein the first holding surface is disposed next to the first positioning surface and the second holding surface is disposed next to the second positioning surface respectively, wherein the catch has a second body section abutting against the first holding surface in a direction radial to the axis of rotation when the first segment is at the first fixed pivotal position relative to the second segment, wherein the second body section is abutted against the second holding surface in a direction radial to the axis of rotation when the first segment is at the second fixed pivotal position relative to the second segment, wherein the first holding surface and the first positioning surface are at different heights, and wherein the second holding surface and the second positioning surface are at different heights; and wherein the second body section has a smaller cross sectional than the first body section, wherein the first holding surface is at a further distance from the axis of rotation than the first positioning surface, and wherein the second holding surface is at a further distance from the axis of rotation than the second positioning surface.

2. The wrench as claimed in claim 1, wherein the catch is axially displaceable along an axis between positions in which the first body section is abutted against either the first positioning surface or the second positioning surface and a position in which the first body section is not abutted against the first and the second positioning surfaces.

3. The wrench as claimed in claim 2, wherein the axis is parallel to the axis of rotation.

4. The wrench as claimed in claim 1, wherein the first and the second segments include an included angle therebetween, wherein the included angle defines a first included angle when the first segment is at the first fixed pivotal position relative to the second segment and a second included angle when the first segment is at the second fixed pivotal position relative to the second segment, and wherein the first and the second included angles have a difference in a range of 5-20 degrees.

5. The wrench as claimed in claim 1, wherein the first joining end has a first side and a second side disposed oppositely and the axis of rotation extends transversely to the first and the second sides, and wherein the first and the second positioning surfaces are adjacent to the first side and the first and the second holding surfaces are adjacent to the second side respectively.

6. The wrench as claimed in claim 1, wherein the first positioning surface is concave and the first holding surface is convex respectively, and wherein the second holding surface and the second positioning surface are concave.

7. The wrench as claimed in claim 1, wherein the catch is urged by a resilient member.

8. The wrench as claimed in claim 1, wherein the catch is movably disposed in a hole, wherein the catch is operable from a third body section thereof, wherein the first and the third body sections are at opposite ends of the catch, and wherein the second body section is disposed between the first and the third body sections.

9. The wrench as claimed in claim 1, wherein the first segment includes two jaws for driving an object to be driven by the wrench and a space between the jaws for receiving the object and wherein the second segment includes a handle end of the wrench.

10. A wrench capable of applying driving force on an object to be driven effectively comprising:

a first segment including a driving end of the wrench, a second segment pivotally coupled to the first segment about an axis of rotation and being selectively positionable at various fixed pivotal positions relative to the first segment, wherein the first and the second segments engage with a locking device which is configured for selectively preventing and allowing rotation of the first segment with respect to the second segment, wherein the first segment has a first joining end forming a first positioning surface and a second positioning surface, wherein the first and the second positioning surfaces are curved, wherein the second segment has at least one second joining end linked to the first joining end and the axis of rotation extends transversely to the first and the second joining ends; and wherein the locking device includes a catch selectively engagable and disengagable from the first and the second positioning surfaces, wherein the first segment is rotatable with respect to the second segment when the catch is disengaged from the first and the second positioning surfaces, wherein the first and the second segments are prevented from rotating relative to one another when the catch is engaged with either the first or the second positioning surface, wherein the catch has a first body section abutting against the first positioning surface in a direction radial to the axis of rotation when the first segment is at a first fixed pivotal position relative to the second segment, and wherein the first body section is abutted against the second positioning surface in a direction radial to the axis of rotation when the first segment is at a second fixed pivotal position relative to the second segment; and wherein the first joining end forms a third positioning surface, wherein the third positioning surface is curved, wherein the first and the second segments are prevented from rotating relative to one another when the catch is engaged with the third positioning surface, wherein the first body section is abutted against the third positioning surface in a direction radial to the axis of rotation when the first segment is at a third fixed pivotal position relative to the second segment, and wherein the first positioning surface is disposed between the second and the third positioning surfaces; and wherein the first joining end forms a first holding surface, a second holding surface, and a third holding surface, wherein the catch is selectively retained by the first, the second, and the third holding surfaces, wherein the catch is selectively engagable and disengagable from the first, the second, and the third holding surfaces, wherein the first holding surface is disposed next to the first positioning surface and the second holding surface is disposed next to the second positioning surface and the third holding surface is disposed next to the third positioning surface respectively, wherein the catch has a second body section abutting against the first holding surface in a direction radial to the axis of rotation when the first segment is at the first fixed pivotal position relative to the second segment, wherein the second body section is abutted against the second holding surface in a direction radial to the axis of rotation when the first segment is at the second fixed pivotal position relative to the second segment, wherein the second body section is abutted against the third holding surface in a direction radial to the axis of rotation when the first segment is at the third fixed pivotal position relative to the second segment, wherein the first holding surface and the first positioning surface are at different heights, wherein the second holding surface and the second positioning surface are at different heights, and wherein the third holding surface and the third positioning surface are at different heights; and wherein the second body section has a smaller cross sectional than the first body section, wherein the first holding surface is at a further distance from the axis of rotation than the first positioning surface, wherein the second holding surface is at a further distance from the axis of rotation than the second positioning surface, and wherein the third holding surface is at a further distance from the axis of rotation than the third positioning surface.

11. The wrench as claimed in claim 10, wherein the first segment and the second segment include an included angle therebetween, wherein the included angle defines a first included angle when the first segment is at the first fixed pivotal position relative to the second segment a second included angle when the first segment is at the second fixed pivotal position relative to the second segment and a third included angle when the first segment is at the third fixed pivotal position relative to the second segment, wherein the first and the second included angles have a difference in a range of 5-20 degrees, and wherein the first and the third included angles have a difference in a range of 5-20 degrees.

12. The wrench as claimed in claim 10, wherein the first joining end has a first side and a second side disposed oppositely and the axis of rotation extends transversely to the first and the second sides, and wherein the first, the second, and the third positioning surfaces are adjacent to the first side and the first, the second, and the third holding surfaces are adjacent to the second side respectively.

13. The wrench as claimed in claim 10, wherein the first positioning surface is concave and the first holding surface is convex respectively, wherein the second holding surface and the second positioning surface are concave, and wherein the third holding surface and the third positioning surface are concave.

14. The wrench as claimed in claim 10, wherein the first joining end forms a first stopping surface adjacent to the second positioning surface, a second stopping surface adjacent to the third positioning surface, a third stopping surface adjacent to the second holding surface, and a fourth stopping surface adjacent to the third holding surface, wherein the second positioning surface is disposed between the first positioning surface and the first stopping surface and the third positioning surface is disposed between the first positioning surface and the second stopping surface respectively, wherein the first and the second stopping surfaces are flat, wherein the second holding surface is disposed between first holding surface and the third stopping surface and the third holding surface is disposed between first holding surface and the fourth stopping surface respectively, and wherein the third and the fourth stopping surfaces are flat.

* * * * *